United States Patent [19]

Yamanashi

[11] Patent Number: 4,557,397

[45] Date of Patent: Dec. 10, 1985

[54] PULL TAB FOR READILY OPENABLE CAN LID

[75] Inventor: Shigeaki Yamanashi, Kanagawa, Japan

[73] Assignee: Toyo Seikan Kaisha, Ltd., Japan

[21] Appl. No.: 686,885

[22] Filed: Dec. 27, 1984

[30] Foreign Application Priority Data

Jul. 24, 1984 [JP] Japan ..... 59-112009

[51] Int. Cl.[4] ..... B65D 17/34

[52] U.S. Cl. ..... 220/270; 220/273

[58] Field of Search ..... 220/266–273

[56] References Cited

U.S. PATENT DOCUMENTS 4,286,728 9/1981 Fraze et al. ..... 220/270

4,383,621 5/1983 Meneghin et al. ..... 220/273

*Primary Examiner*—George T. Hall

*Attorney, Agent, or Firm*—Charles A. Brown

[57] ABSTRACT

A pull tab rivetted to an opening piece defined by a score provided on the lid of a can containing refreshing drink. The pull tab integrally comprises panel portion having a rivet hole, leg portions on the opposite sides of the panel portion and a ring portion contiguous to the ends of the leg portions and remote from the panel portion. The ring portion includes an inner peripheral fold-up and an outer peripheral fold-up and the leg portions include side edge fold-ups and reinforcing fold-ups contiguous to the extreme edges of the side edge fold-ups.

4 Claims, 19 Drawing Figures

PULL TAB FOR READILY OPENABLE CAN LID

BACKGROUND OF THE INVENTION

This invention relates to pull pieces or pull tabs adapted to be removably attached to the lids of various cans containing refreshing drinks for readily opening the cans allowing the user to drink the contents.

Most conventional cans containing refreshing drinks have a pull piece or pull tab 20 removably attached by means of a rivet 18 to an opening piece 15 defined by a cut line or score 16 provided on the lid 10 of a can, as shown in FIG. 7, which allows for removal of the opening piece 15 by pulling the pull tab 20 up, thus enabling the user to drink the contents of the can.

As shown in FIG. 8, the conventional pull tab 20 integrally comprises a panel portion 25 having a rivet hole 26 therein, left-and right-hand leg portions 22, 22 formed on and connected to the opposite sides of the panel portion 25 by means of an intermediate semi-circular ramp and a ring portion 21 contiguous to the ends of the leg portions 22, 22 and remote from the panel portion 25.

The inner peripheral edge of the ring portion 21 is folded back outwardly to form an inner peripheral fold-up 31 and the outer peripheral edge of the ring portion 21 is also folded back inwardly in the opposite direction from the inner peripheral fold-up 31 to form an outer peripheral fold-up 32. The outer side edges of the left- and right-hand leg portions 22, 22 are also folded back inwardly or in the same direction as the outer fold-up 32 of the ring portion 21 to form side edge fold-ups 33, 33 which are contiguous to the outer fold-up 32 at the outer peripheral edge of the ring portion 21.

When the inner and outer peripheral fold-ups 31, 32 of the ring-portion 21 and the outer side edge fold-ups 33 of the leg portions 22 are formed by folding the blank for the pull tab 20, the severed edges of the pull tab 20 which remain sharp as the blank of the pull tab is stamped out of a piece of sheet metal are rounded, as shown in FIG. 9, whereby the pull tab providds a safeguard to the user and rigidity is imparted to the pull tab.

However, in order to impart the pull tab 20 with a rigidity sufficient for tearing the opening piece 15 off the can lid 10 so as to allow the contents of the can to be drunk the conventional pull tab 20 has to be formed of thick sheet metal having a thickness on the order of 0.36 mm, which makes it difficult to reduce the thickness of the pull tab as desired.

SUMMARY OF THE INVENTION

Thus, according to the present invention, the pull tab is formed of sheet metal which is thinner than that for the conventional pull tabs and as a result, the pull tab of the invention can be easily processed and the meterial cost can be cut down, whereby the overall production cost of the pull tab is less.

According to the present invention, a pull tab for a readily openable can lid is provided which integrally comprises a panel portion having a rivet hole therein, left-and right-hand leg portions formed on and connected to the opposite sides of the panel portion by means of an intermediate semi-circular ramp, and a ring portion contiguous to the ends of the leg portions and remote from the panel portion, said ring portion having an inner peripheral fold-up and an outer peripheral fold-up and said legs having outer side edge fold-ups whereby the severed edges of the pull tab are rounded and reinforced, and which is characterized by the fact that a reinforcing fold-up is provided extending from the end of each of the leg portions remote from the ring portion or the line connecting the center of the rivet hole in the panel portion and the outer side edge fold-up associated with each of the leg portions remote from the ring portion to a point where the inner peripheral fold-up of the ring portion diverges from the outer side edge fold-up associated with each of the leg portions whereby the pull tab is reinforced at least in the portion thereof extending from the end of each of the leg portions remote from the ring portion to the above-mentioned point of divergence.

By the provision of the reinforcing fold-up which extends at least from the line connecting the center of the rivet hole in the panel portion and the outer side edge fold-up of each of the leg portions to a point where the inner peripheral fold-up diverges from the outer side edge fold-up of each of the leg portions as mentioned hereinabove, when the pull tab is pulled up to tear the opening piece off the can lid to open the can, the leg portions of the pull tab can be effectively prevented from bending at areas adjacent to the side of the panel portion facing the ring portion to thereby reinforce the pull tab at strategic areas thereof.

The above and other objects and attendant advantages of the present invention will be more readily apparent to those skilled in the art from a reading of the following detailed description in conjunction with the accompanying drawings which show preferred embodiments of the invention and a prior art, respectively, for comparison purposes.

PREFERRED EMBODIMENT OF THE INVENTION

Figure 8:
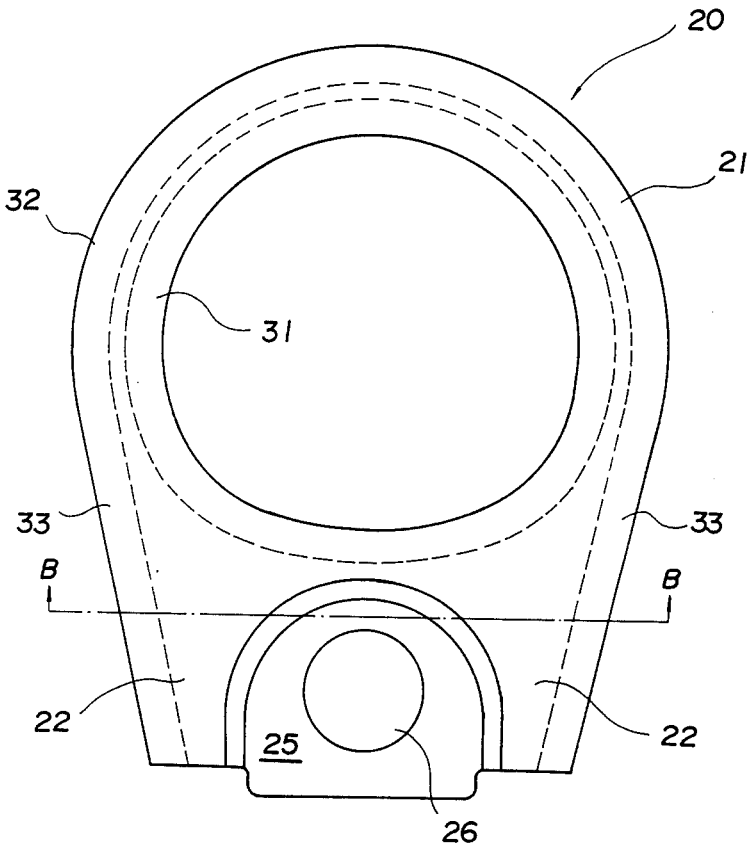
FIG. 8 is a plan view of a prior art pull tab.
Figure 9:
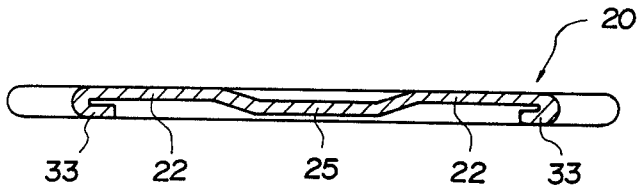
FIG. 9 is a cross-sectional view of the pull tab of FIG. 8 taken along the line B—B therein.

The respective parts of the embodiments of the present invention have affixed thereto the same numerals as those used for the corresponding parts of the prior art as shown in FIGS. 8 and 9.

Figure 1:
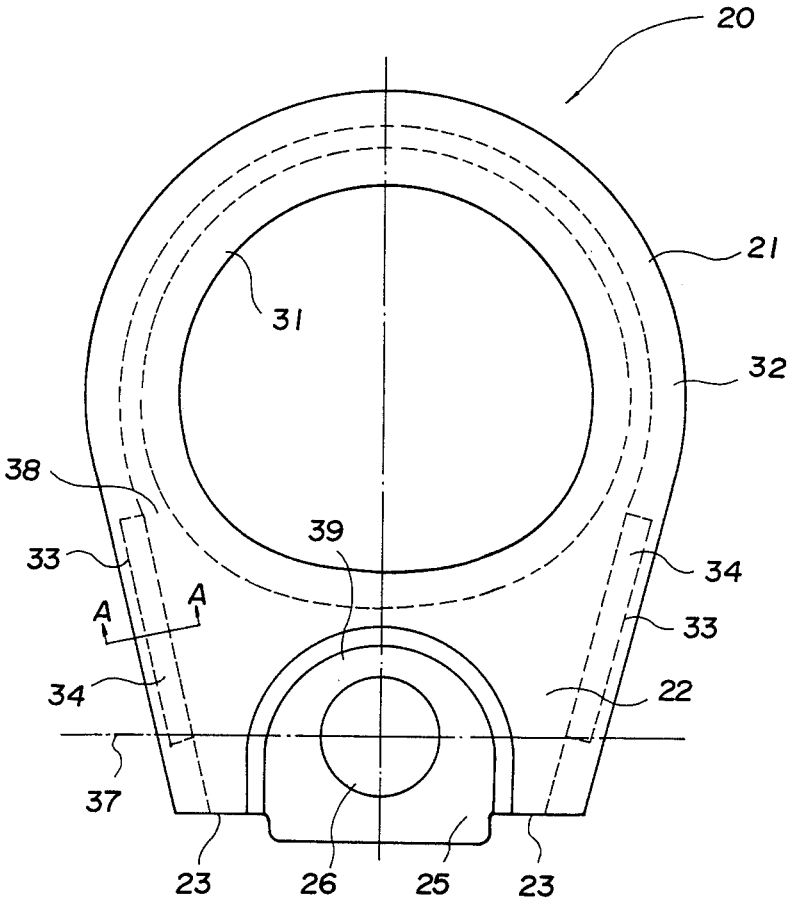
FIG. 1 is a plan view of a first embodiment of the pull tab according to the present invention.

Referring to FIG. 1 wherein the first embodiment of the present invention is shown, in the pull tab 20, a reinforcing fold-up 34 is contiguous to the inner side edge of the outer side edge fold-up 33 of the associated leg portion 22 and extends from the point 38 where the inner peripheral fold-up 31 of the ring portion 21 diverges from the fold-up 33 of each of the leg portions 22 to the horizontal line 37 intersecting the longitudinal axis of the pull tab 20 at right angles thereto and connecting the center of the rivet hole 26 and the outer side edge fold-up 33 of each of the leg portions 22.

Figure 2:
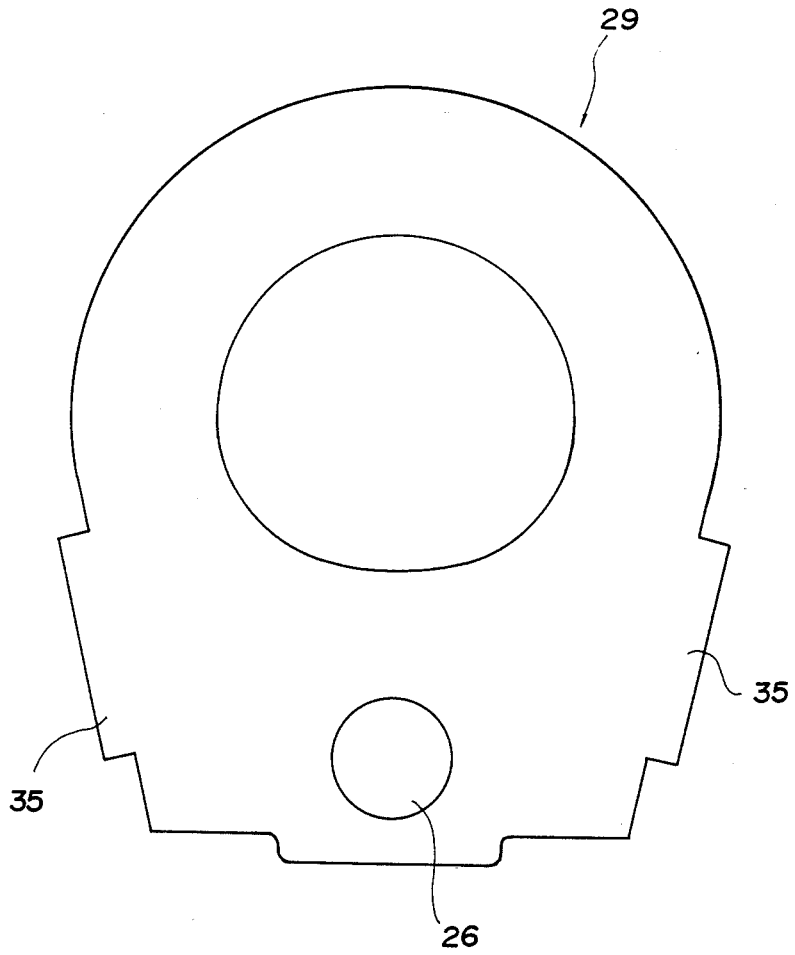
FIG. 2 is a plan view of the blank for the pull tab as shown in FIG. 1.

As more clearly shown in FIG. 2, the blank 29 for the pull tab 20 is stamped out of a piece of sheet metal so as to provide outwardly extending projections 35 on the opposite sides of the pull tab blank 29 and the projections 35 are bent towards the associated leg portion 22 into different configurations such as L-, S- and curled shapes, respectively, as shown in FIGS. 3 to 5 inclusive, to provide the reinforcing fold-ups 34.

In the conventional pull tab 20 as described hereinabove, the outer side edge area of each leg portion 22 has a simple double construction with the outer edge area folded down to provide the fold-up 33 as shown in FIG. 9. In contrast with the conventional pull tab, according to the present invention, the leg portions 22 on the opposite sides of the side 39 of the panel portion 25, where the applied stress concentrates when the pull tab is pulled up for tearing the opening piece 15 off the can lid, are folded back at the outer side edges of the leg portions to provide the fold-ups 33 and the extreme edges of the fold-ups 33 are further folded back towards the associated leg portions 22 into L-, S- and curled configurations, respectively, in order to provide reinforcing fold-ups 34 and thereby to increase the rigidity and resistance against bending of the leg portions 22.

Figure 3A:
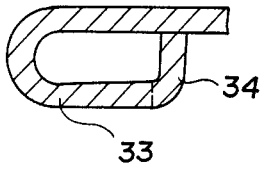
FIGS. 3 through 5 are fragmentary cross-sectional views taken along the line A—A of FIG. 1 showing a variety of reinforcing arrangements to be formed in the pull tab according to the present invention.
Figure 3B:
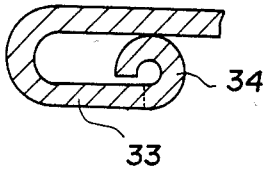
Figure 3C:
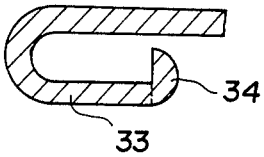
Figure 3D:
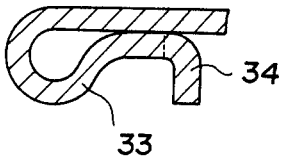
Figure 3E:
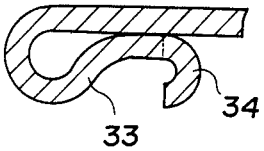

In FIG. 3A, the reinforcing fold-up 34 extends from the extreme edge of the associated fold-up 33 at right angles thereto and abuts against the associated leg portion 22, in FIG. 3B, the reinforcing fold-up 34 extends from the extreme edge of the associated fold-up 33 in a curled configuration and abuts against the associated leg portion 22, in FIG. 3C, the reinforcing fold-up 34 extends from the extreme edge of the associated fold-up 33 at right angles thereto and terminates short of the associated portion 22, and in FIGS. 3D and 3E, the reinforcing fold-ups 34 extend from the extreme edges of the associated fold-ups 33 in different substantially S-shaped configurations and abut against the associated leg portions 22, respectively.

Figure 4A:
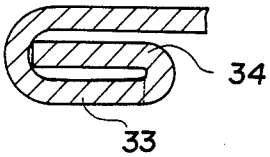
Figure 4B:
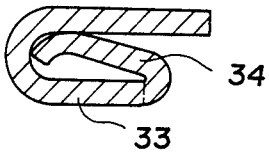
Figure 4C:
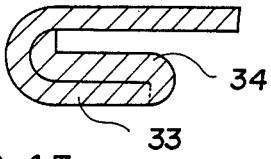
Figure 4D:
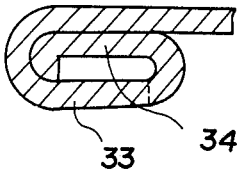
Figure 4E:
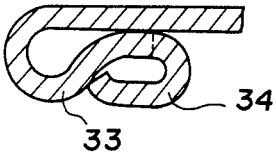

FIGS. 4A, 4B, 4C, 4D and 4E show different triple reinforcing arrangements. Each of the triple reinforcing arrangements. Each of the triple reinforcing arrangements is obtained by stamping the blank for the pull tab out of a piece of sheet metal so that the projections 35 have a greater width on the opposite sides thereof and folding the projections down as shown in these Figures. In FIG. 4A, the reinforcing fold-up 34 extends from the extreme edge of the associated fold-up 33 first at right angles thereto and then in parallel to and spaced from the associated leg portion 22 and fold-up 33, in FIG. 4B, the reinforcing fold-up 34 extends from the extreme edge of the associated fold-up 33 first at an upwardly sloped angle and then sloping downwardly to abut against the associated fold-up 33, in FIG. 4C, the reinforcing fold-up 34 extends from the extreme edge of the associated fold-up 33 first horizontally in contact therewith and then uprightly to abut against the associated leg portion, in FIG. 4D, the reinforcing fold-up 34 extends from the extreme edge of the associated fold-up 33 first at right angles thereto, then horizontally in contact with the associated leg portion 22 and finally downwardly at right angles to the leg portion 22 and fold-up 33 to abut against the latter, and in FIG. 4E, the reinforcing fold-up 34 extends from the extreme edge of the associated fold-up 33 in a substantially S-shaped configuration and abuts against the associated leg portion.

Figure 5A:
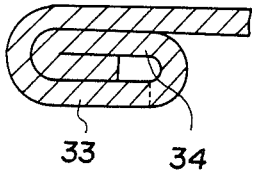
Figure 5B:
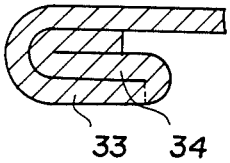
Figure 6:
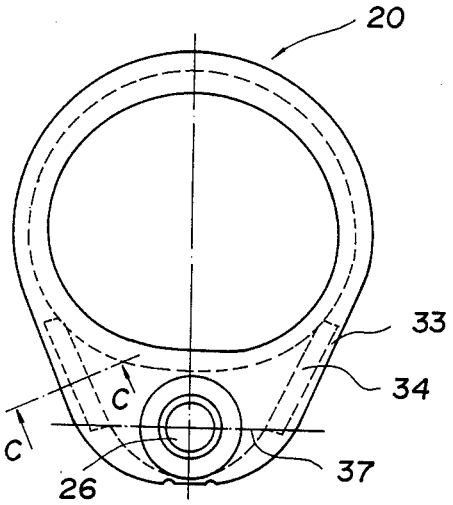
FIG. 6 is a plan view of another embodiment of the pull tab according to the present invention.
Figure 7:
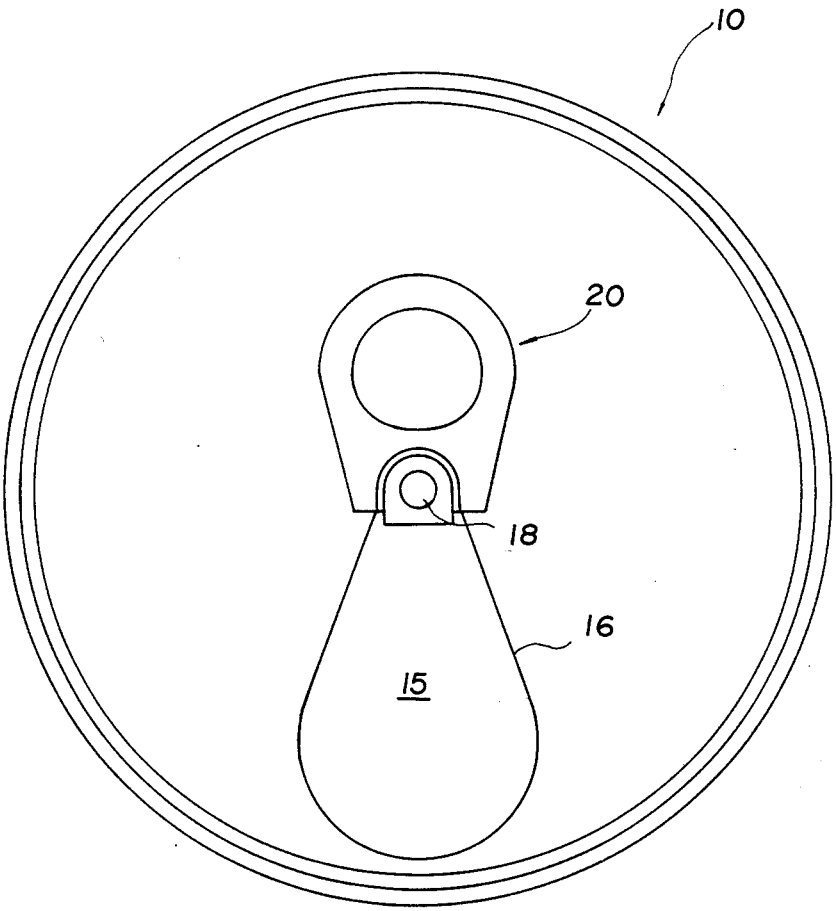
FIG. 7 is a plan view of the lid for a readily openable can to which the prior art and instant pull tabs are adapted to be removably rivetted.

FIGS. 5A and 5B show two types of quadruple reinforcing arrangements. As will be apparent, the blanks for the pull tabs of these Figures have projections 15 greater than those on the blanks for pull tabs in FIG. 4 with respect to width. In FIG. 5A, the reinforcing fold-up 34 extends from the extreme edge of the associated fold-up 33 in a substantially L-shaped configuration with the longer and shorter legs of the L-shape in contact with the associated leg portion 22 and fold-up 33, respectively and in FIG. 5B, although the reinforcing fold-up 34 extends from the extreme edge of the associated fold-up 33 in a substantially L-shape, the longer and shorter legs of the L-shape are in contact with the fold-up 33 and leg portion, respectively.

When the reinforcing fold-up forming projections 35 do not extend from a position adjacent to the horizontal line 37 passing through the center of the rivet hole 28, but extend from the ends 23 of the leg portions 22, 22 remote from the ring portion 21 to a position adjacent to the point 38 where the fold-up 31 on the ring portion diverges from the fold-up 33 of each of the leg portions, as shown on FIG. 9, the blank has a simpler shape, which makes it easy to stamp the blank out of a piece of sheet metal and fold the blank to form the fold-ups 33 and reinforcing fold-ups 34.

The pull tab 20 of the invention is not limited to the linear shape at the panel portion end as shown in FIG. 1, but may, within the scope of the invention, be arcuate also at that end. In such as case, the panel portion 25 is circular in shape (FIG. 9).

Figure 10:
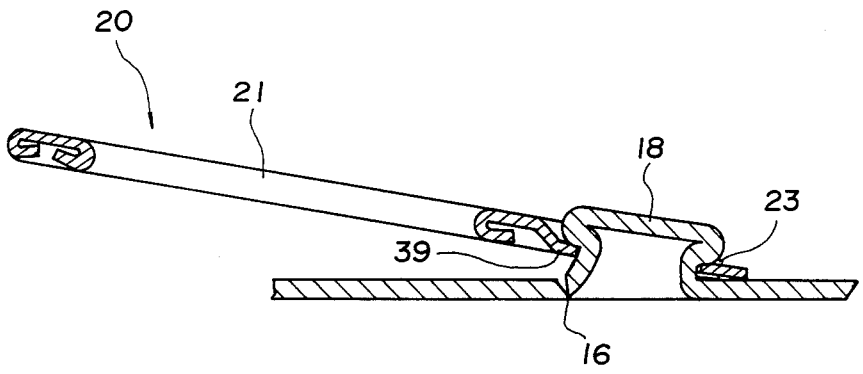
FIG. 10 is a fragmentary cross-sectional view of the central portion of the pull table when the pull tab is removed from the lid.

The operation of the pull tab 20 will now be described, referring to FIG. 10. When the pull tab is pulled up to tear the opening piece 15 off along the score 16, the pull tab acts as a lever with the point of force at the ring portion 21, the fulcrum at the ends 23 of the leg portions 22 and the point of operation at the rivet hole 26. The force applied to the ring portion 21 as the pull tab is pulled up for tearing the opening piece 15 off along the score 16 so as to open the can lid is transmitted to the rivet 18, from where the force is transmitted to the score 16 such as to cut through the same.

In the pull tab 20 acting as a lever in this way, most of the applied stress is concentrated in an area adjacent to the side 39 of the panel portion 25.

Thus, the leg portions 22 frequently bend on the side 39 of the panel portion 25 which not only makes it difficult to open the can, but also causes the pull tab 20 to slip off the rivet 18 to such an extent that opening of the can becomes impossible.

In order to prevent the leg portions 22 from bending, according to the present invention, the reinforcing fold-ups 34 are provided on the fold-ups 33 of the leg portions 22 extending from a position adjacent to the horizontal line 37 passing through the center of the rivet hole 26 to a position adjacent to the point 38 where the inner peripheral fold-up 31 of the ring portion 21 diverges from the fold-up 33 of each of the leg portions 22 so that the leg portions 22 are reinforced at areas adjacent to the side 39 of the panel portion 25 where most of the applied stress is concentrated.

As mentioned hereinabove, according to the present invention, in order to cover the side 39 of the panel portion 25 where most of the applied stress is concentrated when the can is opened, the reinforcing fold-ups 34 are formed on the leg portions 22 extending from a position adjacent to the horizontal line 37 passing through the center of the rivet hole 26 in the panel portion 25 to a position adjacent to the point 38 where the inner peripheral fold-up 31 on the ring portion 21 diverges from the fold-ups 33 on the leg portions 22 so as to impart rigidity to the pull tab in accordance with a particular stress distribution. Thus, the pull tab of the present invention may be formed of 0.30 mm thick sheet metal which is thinner than the conventional pull tab formed of 0.36 mm thick sheet metal. Since the pull tab 20 of the invention (FIG. 1) is formed by stamping the blank 29 off a piece of sheet metal so as to provide the pull tab with the reinforcing fold-ups 34, material costs can be reduced. In addition, since the blank is formed of thin sheet metal, the blank can be easily bent so as to form the inner and outer peripheral fold-ups 31, 32 on the ring portion 21 and the fold-ups 33 on the leg portions 22 and thereby to enhance the production efficiency of the pull tab 20.

While only two embodiments of the invention have been shown and described in detail, it will be understood that the same are for illustration purposes only and not to be taken as a definition of the invention, reference to the appended claims being available for this purpose.

What is claimed is:

1. In a pull tab for a readily openable can lid integrally comprising a panel portion having a rivet hole, leg portions on the opposite sides of said panel portion and a ring portion contiguous to the ends of said leg portions and remote from said panel portion, said ring portion including an inner peripheral fold-up and an outer peripheral fold-up and said leg portions including outer side edge fold-ups contiguous to said outer peripheral fold-up on the ring portion such as to cover the severed edges of the pull tab and impart rigidity to the pull tab, characterized by reinforcing fold-ups contiguous to the extreme edges of said side edge fold-ups on the leg portions and extending from a line connecting the center of said rivet hole and said side edge fold-ups on the leg portions to a position adjacent to the point where said inner peripheral fold-up on the ring portion diverages from said outer side edge fold-ups on the leg portions.

2. The pull tab as set forth in claim 1, in which each of said reinforcing fold-ups forms a double reinforcing arrangement in cooperation with the associated leg portion and outer side edge fold-up.

3. The pull tab as set forth in claim 1, in which each of said reinforcing fold-ups forms a triple reinforcing arrangement in cooperation with the associated leg portion and outer side edge fold-up.

4. The pull tab as set forth in claim 1, in which each of said reinforcing fold-ups forms a quadruple reinforcing arrangement in cooperation with the associated leg portion and outer side edge fold-up.

* * * * *